US011198148B1

(12) United States Patent
Meloche

(10) Patent No.: US 11,198,148 B1
(45) Date of Patent: Dec. 14, 2021

(54) DISPENSER ASSEMBLY AND METHOD FOR MANUFACTURING THE DISPENSER ASSEMBLY

(71) Applicant: Joseph L. Meloche, Rochester Hills, MI (US)

(72) Inventor: Joseph L. Meloche, Rochester Hills, MI (US)

( * ) Notice: Subject to any disclaimer, the term of this patent is extended or adjusted under 35 U.S.C. 154(b) by 0 days.

(21) Appl. No.: 17/086,340

(22) Filed: Oct. 31, 2020

(51) Int. Cl.
*B05C 17/005* (2006.01)
*B65D 83/00* (2006.01)

(52) U.S. Cl.
CPC .. *B05C 17/00593* (2013.01); *B05C 17/00553* (2013.01); *B65D 83/0022* (2013.01)

(58) Field of Classification Search
CPC ..... B05C 17/00593; B05C 17/00553; B05C 17/00513; B05C 17/00516; B05C 17/00559; B05C 17/00583; B05C 17/0146; B65D 83/0022; B65D 81/325; B65D 83/0072
See application file for complete search history.

(56) References Cited

U.S. PATENT DOCUMENTS 1,626,487 A * 4/1927 Warren ..... B01F 5/0405 366/163.2
3,952,920 A 4/1976 Bergman
4,538,920 A 9/1985 Drake
5,566,860 A * 10/1996 Schiltz ..... B05C 17/00513 222/105
5,954,236 A 9/1999 Virnelson
7,748,567 B2 * 7/2010 Horner ..... B65D 81/325 222/135
8,631,973 B2 * 1/2014 Grundler ..... A61C 5/62 222/137
8,881,950 B2 * 11/2014 Pappalardo ..... B05C 17/01 222/137
2010/0206904 A1 * 8/2010 Staub ..... B05C 17/00553 222/137
2011/0056985 A1 * 3/2011 Bublewitz ..... B05C 17/00579 222/137
2013/0026255 A1 * 1/2013 Hamman ..... A61M 3/005 239/461

* cited by examiner

*Primary Examiner* — Donnell A Long
(74) *Attorney, Agent, or Firm* — Buckert Patent & Trademark Law Firm PC; John F. Buckert

(57) ABSTRACT

A dispenser assembly having a plunger and a housing is provided. The plunger has an inner plunger portion and an outer plunger portion disposed concentrically around the inner plunger portion. The housing has an inner tubular housing wall, an outer tubular housing wall, and first and second outlet members. The outer tubular housing wall is disposed concentrically around the inner tubular housing wall. The inner tubular housing wall defines a first interior region therein, and the inner tubular housing wall and the outer tubular housing wall define a second interior region therebetween. The first and second outlet members fluidly communicate with the first and second interior regions, respectively. The inner plunger portion is slidably received in the first interior region. The outer plunger portion is slidably received in the second interior region.

15 Claims, 9 Drawing Sheets

DISPENSER ASSEMBLY AND METHOD FOR MANUFACTURING THE DISPENSER ASSEMBLY

BACKGROUND

Two-component epoxies have been used for adhesive and sealing needs. The two-component epoxies have a resin and an activator which causes the resin to harden. The resin and activator have been held within a hand-actuated dispenser. The hand-actuated dispenser includes first and second distinct syringe bodies coupled side-by-side, and the first and second distinct plungers coupled side-by-side and attached together on a top surface thereof. The first syringe body holds an activator, and the syringe body holds a resin therein.

When a force is applied to the top surface of the first and second plungers, the first plunger contacts the resin in the first syringe body, and the second plunger contacts the activator in the second syringe, which causes the resin and activator to flow out of fluid ports. The resin and the activator, however, are materials with very different viscosities and flow characteristics. As a result, when a force is applied to the top surface that tilts the first and second plungers relative to the first and second syringe bodies, respectively, the lower viscosity material exits a fluid port more quickly than the higher viscosity material exits another fluid port, and the first plunger immediately strikes an angle relative to a longitudinal axis of the first syringe body, which reduces an amount of higher viscosity material that is dispensed. As a result, a mix ratio (e.g., amount of resin/amount of activator) of the dispensed materials may be incorrect, and the mixed materials (e.g., resin and activator) may not properly harden as desired.

The inventor herein has recognized a need for an improved dispenser assembly which will eliminate and/or reduce the above-identified deficiency.

SUMMARY

A dispenser assembly for dispensing first and second chemical compounds in accordance with an exemplary embodiment is provided. The dispenser assembly includes a plunger having an inner plunger portion and an outer plunger portion. The outer plunger portion is disposed concentrically around the inner plunger portion. The dispenser assembly further includes a housing having an inner tubular housing wall, an outer tubular housing wall, a bottom housing wall, and first and second outlet members. The inner tubular housing wall and the outer tubular housing wall are coupled to and extend from the bottom housing wall such that the outer tubular housing wall is disposed concentrically around the inner tubular housing wall. The inner tubular housing wall defines a first interior region therein. The inner tubular housing wall and the outer tubular housing wall define a second interior region therebetween. The first outlet member is coupled to the bottom housing wall and fluidly communicates with the first interior region. The second outlet member is coupled to the bottom housing wall and fluidly communicates with the second interior region. The inner plunger portion is slidably received in the first interior region. The outer plunger portion is slidably received in the second interior region.

A method for manufacturing a dispenser assembly in accordance with another exemplary embodiment is provided. The method includes providing a plunger having an inner plunger portion and an outer plunger portion. The outer plunger portion is disposed concentrically around the inner plunger portion. The method further includes providing a housing having an inner tubular housing wall, an outer tubular housing wall, a bottom housing wall, and first and second outlet members. The inner tubular housing wall and the outer tubular housing wall are coupled to and extend from the bottom housing wall such that the outer tubular housing wall is disposed concentrically around the inner tubular housing wall. The inner tubular housing wall defines a first interior region therein. The inner tubular housing wall and the outer tubular housing wall define a second interior region therebetween. The first outlet member is coupled to the bottom housing wall and fluidly communicates with the first interior region. The second outlet member is coupled to the bottom housing wall and fluidly communicates with the second interior region. The method further includes disposing a first chemical compound in the first interior region. The method further includes disposing a second chemical compound in the second interior region. The method further includes slidably coupling the plunger to the housing such that a portion of the inner plunger portion is disposed in the first interior region, and a portion of the outer plunger portion is disposed in the second interior region.

DETAILED DESCRIPTION

Figure 1:
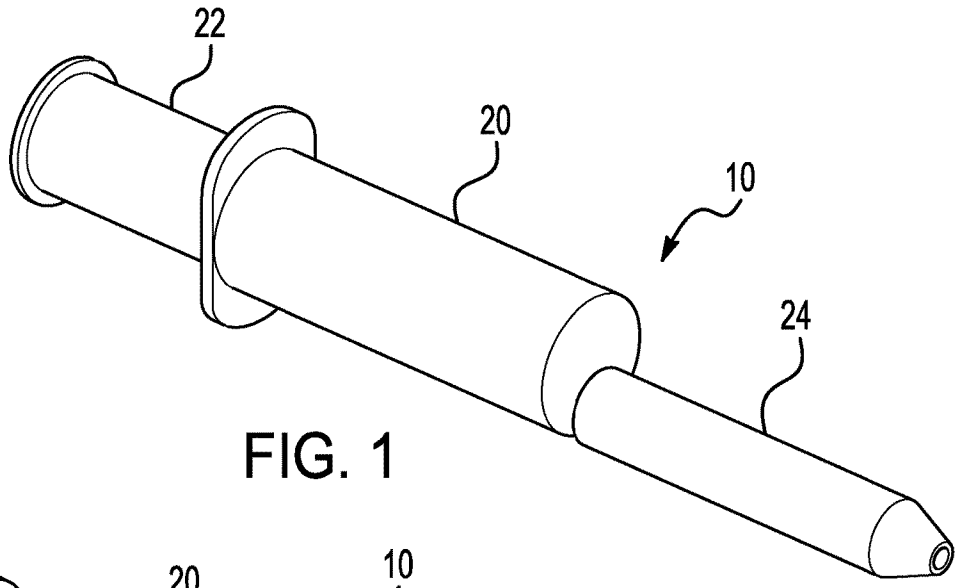
FIG. 1 is a schematic of a dispenser assembly in accordance with an exemplary embodiment.

Referring to FIGS. 1-19, a dispenser assembly 10 for dispensing chemical compounds in accordance with an exemplary embodiment are provided. The dispenser assembly 10 includes a housing 20, a plunger 22, a static mixer assembly 24, a first chemical compound 26, and a second chemical compound 28.

An advantage of the dispenser assembly 10 is that the assembly 10 dispenses a consistent mix ratio of the first and second chemical compounds 26, 28 (e.g., desired amount of first chemical compound 26/desired amount of second chemical compound 28) even if a longitudinal axis 96 (shown in FIG. 19) of the plunger 22 is tilted/offset from a longitudinal axis 64 (shown in FIG. 18) of the housing 20 during use thereof. In particular, referring to FIG. 7, the dispenser assembly 10 utilizes the plunger 22 with an inner plunger portion 92 and an outer plunger portion 94 concentrically disposed around the inner plunger portion 92 to urge the first and second chemical compounds 26, 28, respectively, in first and second interior regions 60, 62, respectively, to be dispensed at a desired mix ratio. In an exemplary embodiment, the first chemical compound 26 is a resin and the second chemical compounds 28 is an activator for hardening the resin. In an alternative embodiment, the first chemical compound 26 is an activator for hardening the resin, and the second chemical compounds 28 is the resin.

Referring to FIGS. 7, 8, 10-12, 18 and 19, the housing 20 is provided to hold the remaining components of the dispenser assembly 10 thereon. The housing 20 includes an inner tubular housing wall 50, an outer tubular housing wall 52, a bottom housing wall 54, a top housing wall 55, a first outlet member 56, a second outlet member 58, and a longitudinal axis 64 (shown in FIG. 18).

The inner tubular housing wall 50 and the outer tubular housing wall 52 are coupled to and extend from the bottom housing wall 54 such that the outer tubular housing wall 52 is disposed concentrically around the inner tubular housing wall 50. The bottom wall 52 has apertures 80, 82 (shown in FIG. 12) extending therethrough that communicate with the first and second outlet members 56, 58, respectively. The inner tubular housing wall defines a first interior region 60 therein. The inner tubular housing wall 50 and the outer tubular housing wall 52 define a second interior region 62 therebetween. The bottom housing wall 55 includes a coupling portion 67. The first outlet member 56 is coupled to and extends from the coupling portion 67 of the bottom housing wall 54 and fluidly communicates with the first interior region 60 via the aperture 80 (shown in FIG. 12). The second outlet member 62 is coupled to and extends from the coupling portion 67 of the bottom housing wall 54 and fluidly communicates with the second interior region 62 via the aperture 82. The top housing wall 55 is coupled to a top end of the outer tubular housing wall 52 and has an outer circumference that is larger than an outer circumference of the outer tubular housing wall 52. In an exemplary embodiment, the housing 20 is constructed of plastic. Further, in an exemplary embodiment, the volume of the first interior region 60 is equal to the volume of the second interior region 62. Of course, in an alternative embodiment, the volume of the first interior region 60 could be greater than or less than the volume of the second interior region 62.

Figure 7:
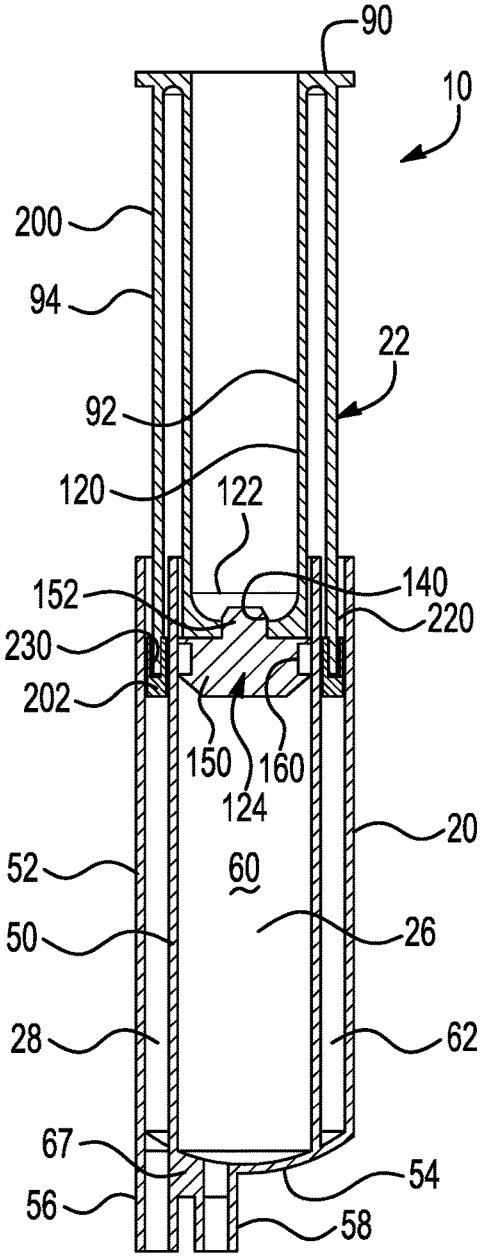
FIG. 7 is a cross-sectional schematic of the dispenser assembly of FIG. 4 taken along lines 7-7.
Figure 8:
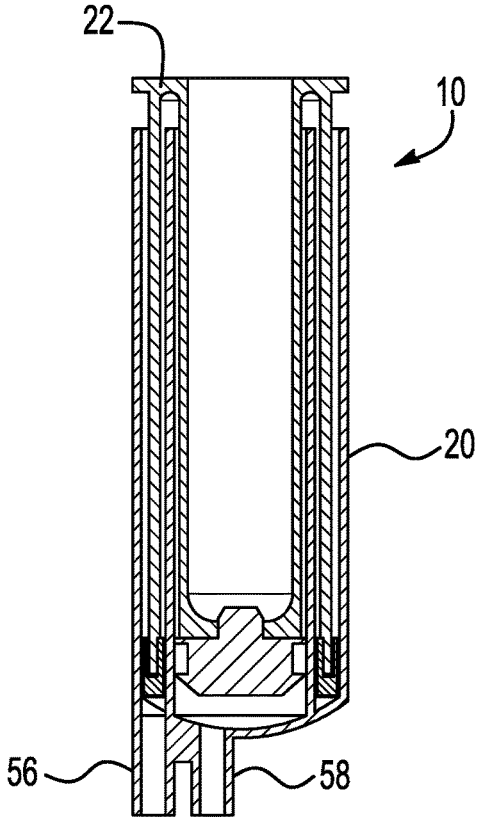
FIG. 8 is a cross-sectional schematic of the dispenser assembly of FIG. 5 taken along lines 8-8.
Figure 9:
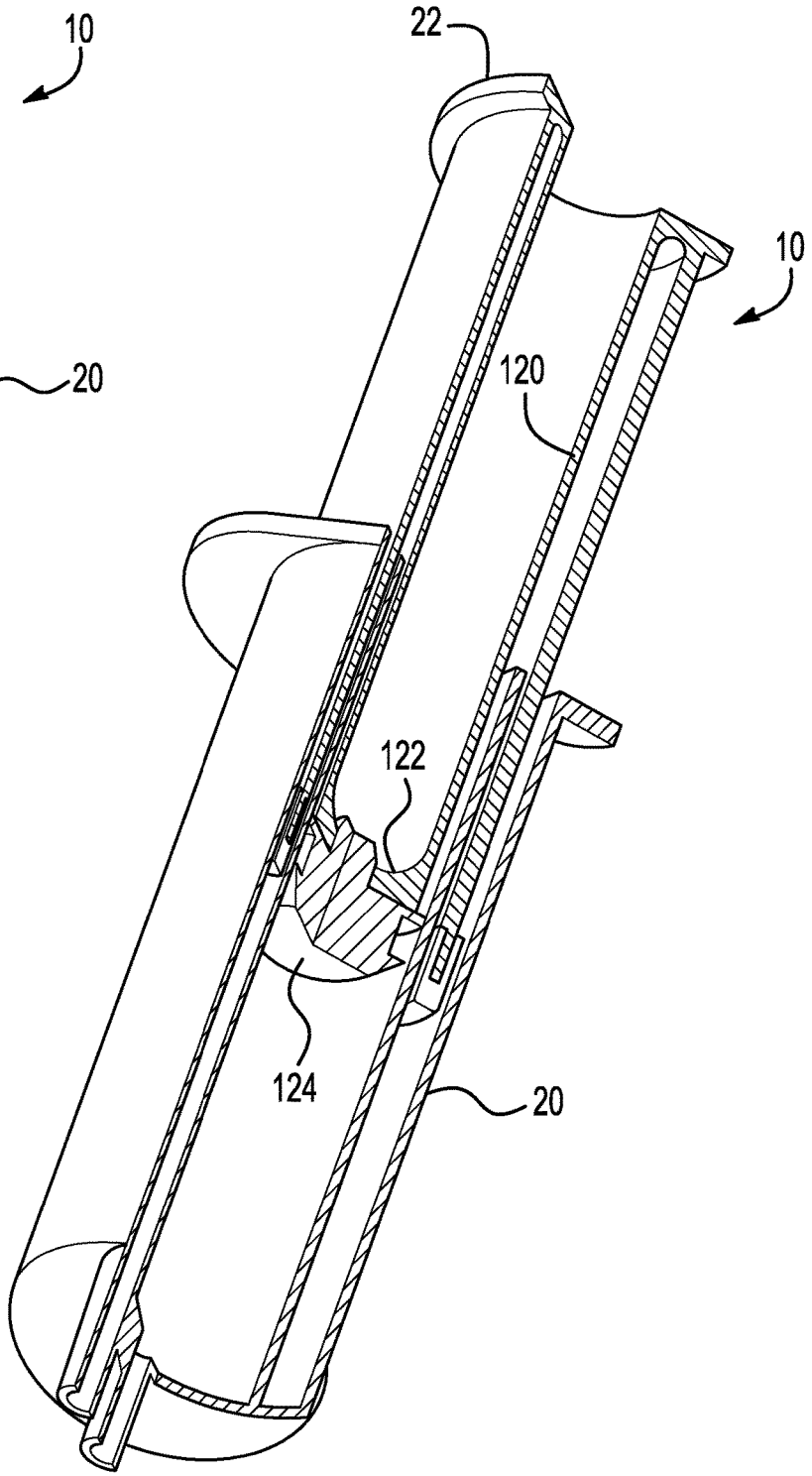
FIG. 9 is a cut-a-way view of a portion of the dispenser assembly of FIG. 4.
Figure 10:
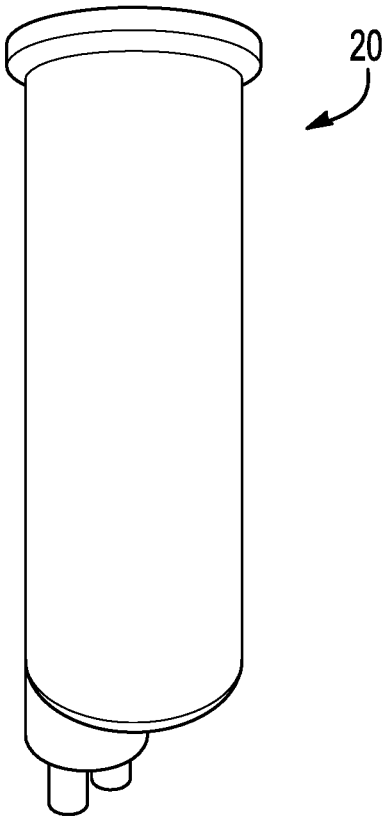
FIG. 10 is a schematic of a housing utilized in the dispenser assembly of FIG. 1.
Figure 11:
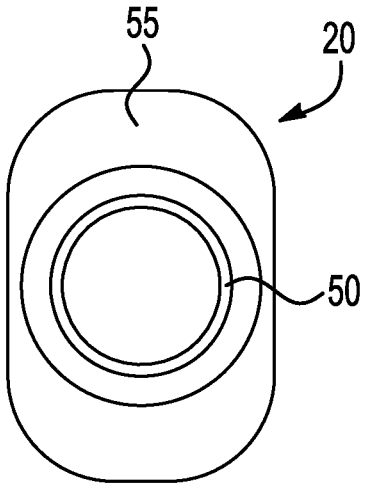
FIG. 11 is a top view of the housing of FIG. 10.
Figure 12:
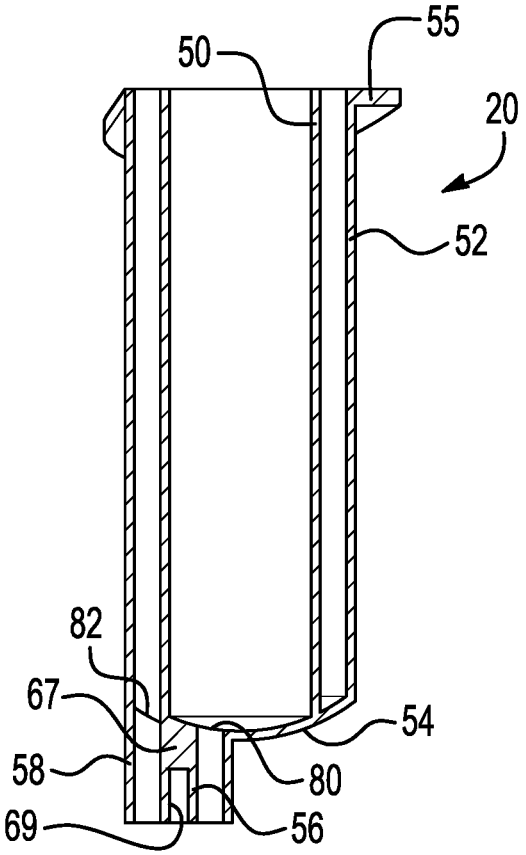
FIG. 12 is a cut-a-way view of a portion of the housing of FIG. 10.
Figure 13:
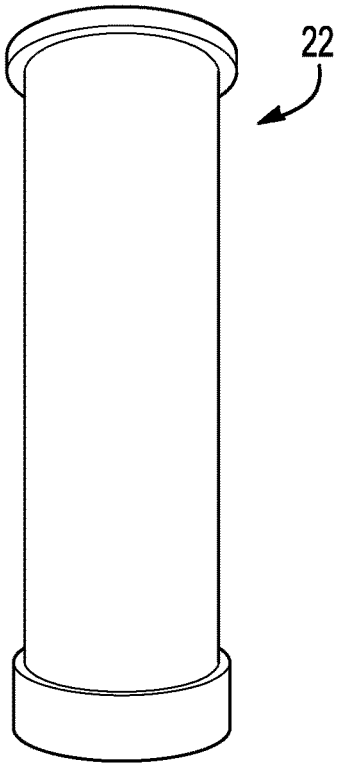
FIG. 13 is a schematic of a plunger utilized in the dispenser assembly of FIG. 1.
Figure 14:
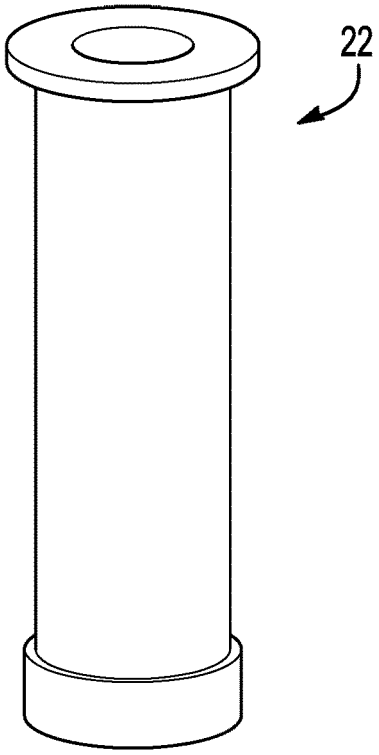
FIG. 14 is another schematic of the plunger of FIG. 13.
Figure 15:
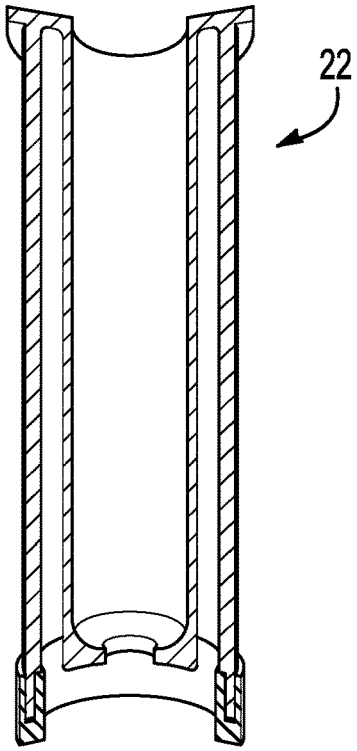
FIG. 15 is a cut-a-way view of a portion of the plunger of FIG. 14.
Figure 16:
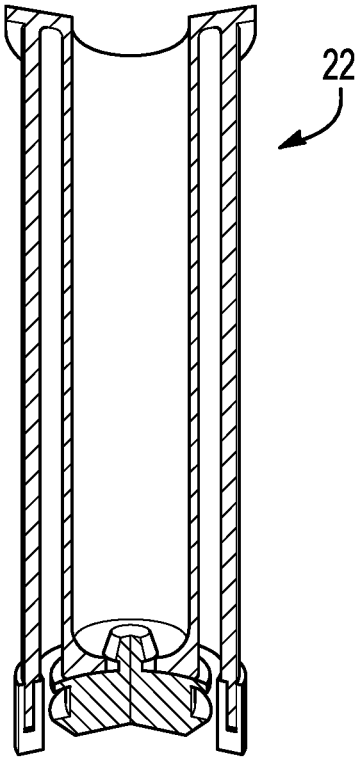
FIG. 16 is another cut-a-way view of a portion of the plunger of FIG. 14.
Figure 19:
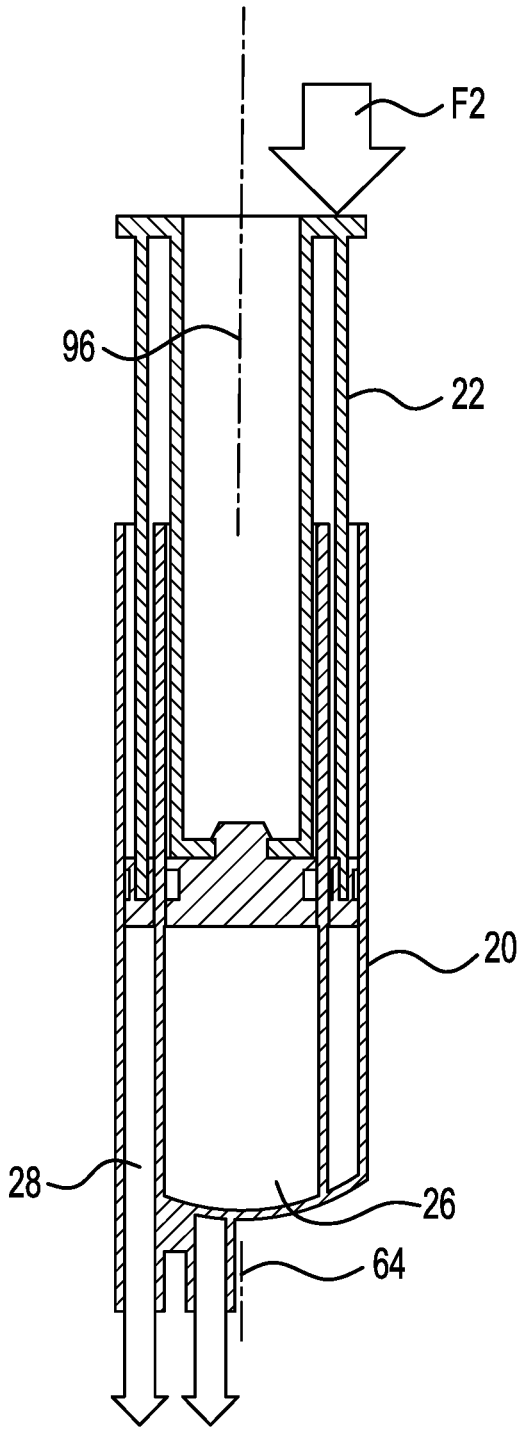
FIG. 19 is another simplified diagram of the housing and plunger, utilized in the dispenser assembly of FIG. 1, with the plunger at a second operational position.

Referring to FIGS. 7 and 19, the plunger 22 is provided to contact the first and second chemical compounds 26, 28 in the first and second interior regions 60, 62, respectively in the housing 20, to urge the chemical compounds 26, 28 through the first and second outlet members 56, 58, respectively. The plunger 22 includes a top plunger wall 90, an inner plunger portion 92, an outer plunger portion 94, and a longitudinal axis 96.

Referring to FIG. 7, the inner plunger portion 92 includes an inner tubular plunger wall 120, a bottom plunger wall 122, and a tip member 124. The inner tubular plunger wall 120 and the outer tubular plunger wall 122 are coupled to and extend from the top plunger wall 90 such that an outer tubular plunger wall 200 of the outer plunger portion 94 is disposed concentrically around the inner tubular plunger wall 120. In an exemplary embodiment, the inner tubular plunger wall 120 and the bottom plunger wall 122 are constructed of plastic.

The bottom plunger wall 122 is coupled to an end of the inner tubular plunger wall 120. The bottom plunger wall 122 includes an aperture 140 extending therethrough.

The tip member 124 is coupled to the bottom plunger wall 122 and communicates with the first interior region 60 of the housing 20. The tip member 124 has a main tip body 150 and a coupling tab 152 coupled to the main tip body 150. The coupling tab 152 extends through the aperture 140 in the bottom plunger wall 122 to couple the tip member 124 to the bottom plunger wall 122. The main tip body 150 has a groove 160 extending into and circumferentially around the main tip body 150. In an exemplary embodiment, the tip member 124 is an elastomeric tip member.

The outer plunger portion 94 is disposed concentrically around the inner plunger portion 92. The outer plunger portion 94 has an outer tubular plunger wall 200 and an annular seal 202. The annular seal 202 is coupled to an end portion 220 of the outer tubular plunger wall 94. In particular, the annular seal 202 has a groove 230 extending from a top surface thereof into the annular seal 202. The end portion 220 of the outer tubular plunger wall 94 extends into the groove 230 to couple the outer tubular plunger wall 200 to the annular seal 202. In an exemplary embodiment, the outer tubular plunger wall 200 is constructed of plastic, and the annular seal 202 is an elastomeric annular seal.

The top plunger wall 90 is coupled to a top end of the inner tubular plunger wall 120 and the outer tubular plunger wall 200. In an exemplary embodiment, the top plunger wall 90 is substantially ring-shaped and has an outer circumference than is larger than an outer circumference of the outer tubular plunger wall 200.

Figure 18:
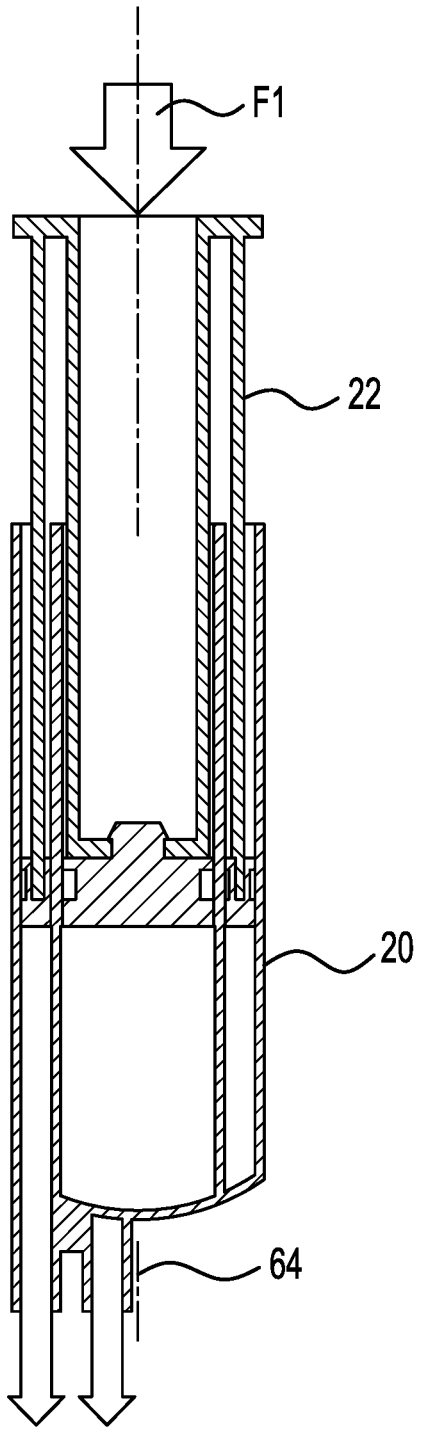
FIG. 18 is a simplified diagram of the housing and plunger, utilized in the dispenser assembly of FIG. 1, with the plunger at a first operational position.

Referring to FIG. 18, when an operator applies a force F1 to the plunger 22 along the longitudinal axis 96 of the plunger 22, the longitudinal axis 96 of the plunger 22 aligns (e.g., is coincident) with the longitudinal axis 64 of the housing 22. In this situation, a desired amount (e.g., an equal amount) of the first and second chemical compounds 26, 28, are dispensed from the first and second outlet members 56, 58, respectively.

Referring to FIG. 19, when an operator applies a force F2 to the plunger 22 a predetermined distance from the longitudinal axis 96 of the plunger 22, the longitudinal axis 96 of the plunger 22 is slanted (e.g., disposed at an offset angle) with respect to the longitudinal axis 64 of the housing 22. Even in this situation, a desired amount (e.g., an equal amount) of the first and second chemical compounds 26, 28, are dispensed from the first and second outlet members 56, 58, respectively.

Figure 2:
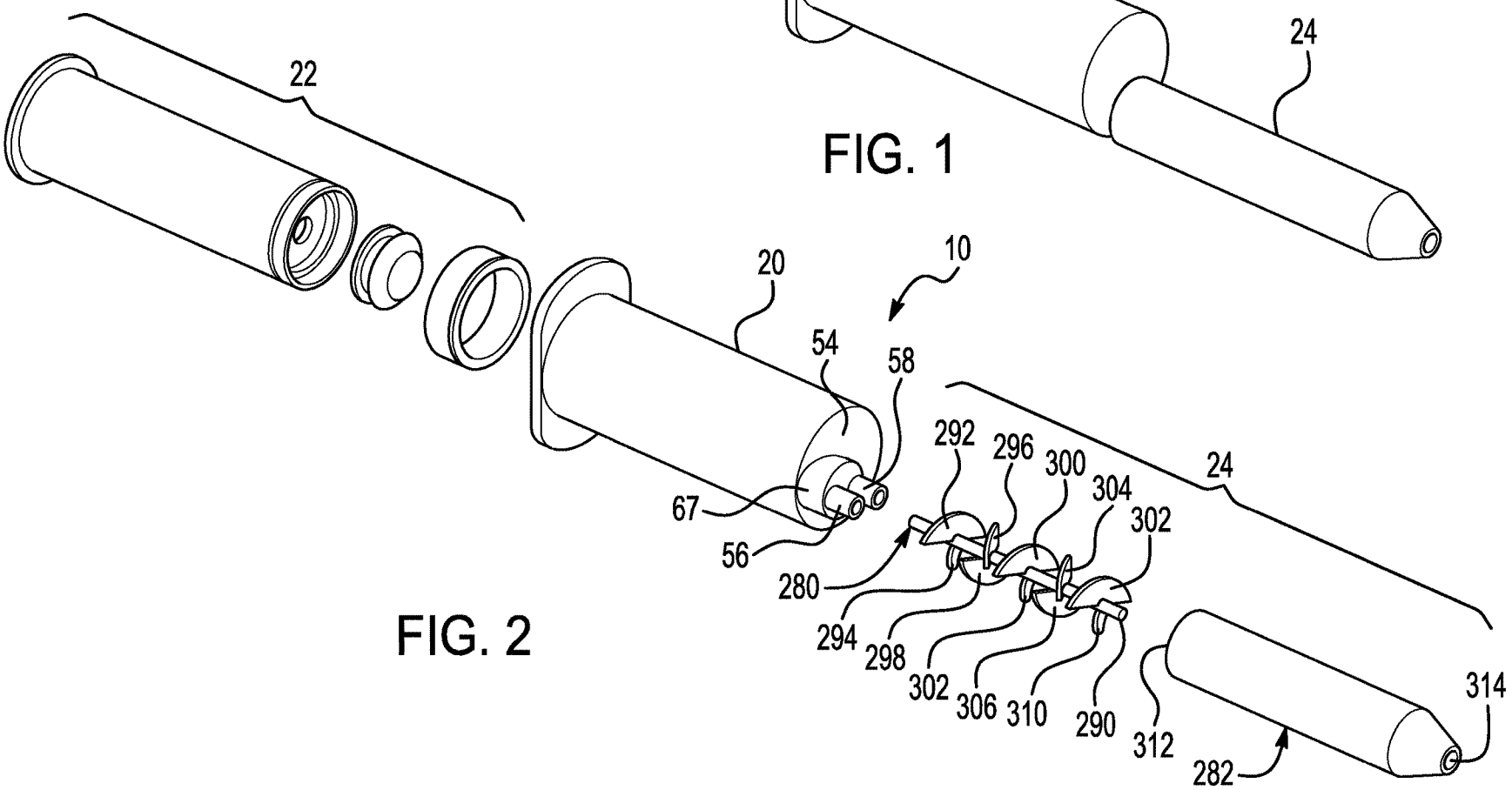
FIG. 2 is an exploded view of the dispenser assembly of FIG. 1.
Figure 3:
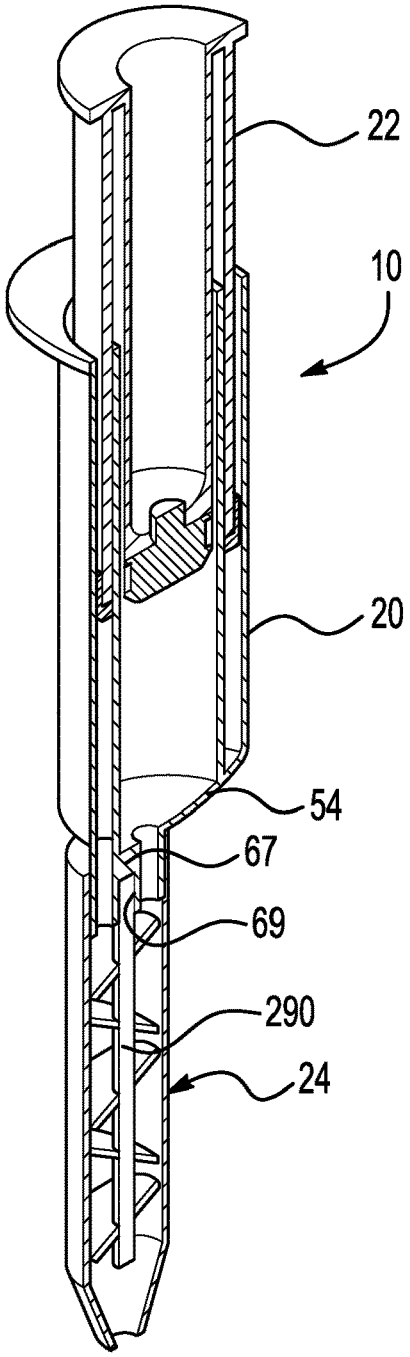
FIG. 3 is a cross-sectional view of the dispenser assembly of FIG. 1.
Figure 4:
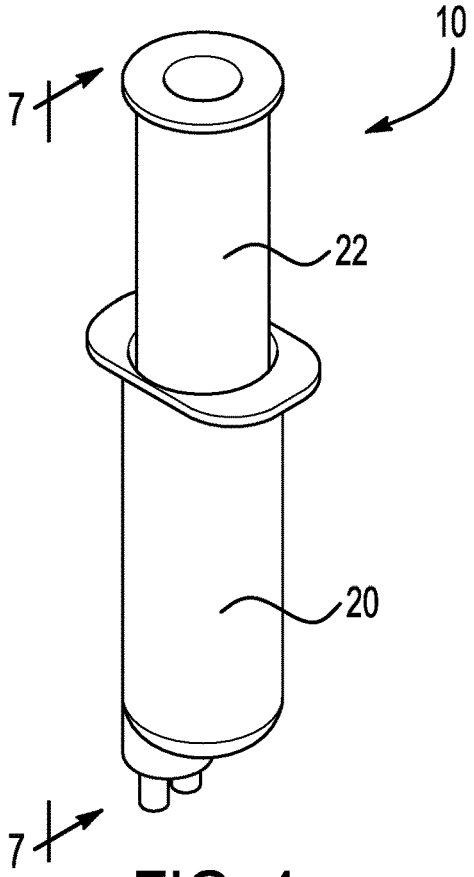
FIG. 4 is a schematic of a housing and a plunger of the dispenser assembly of FIG. 1 with the plunger at a first operational position.
Figure 5:
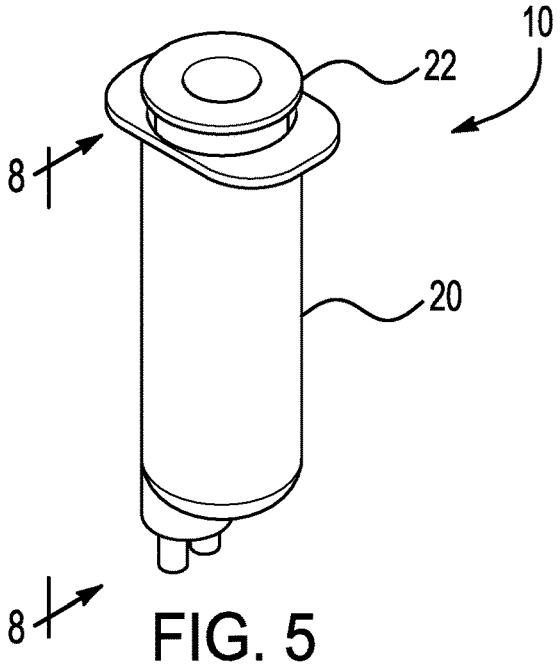
FIG. 5 is a schematic of the housing and the plunger of the dispenser assembly of FIG. 1 with the plunger at a second operational position.
Figure 6:
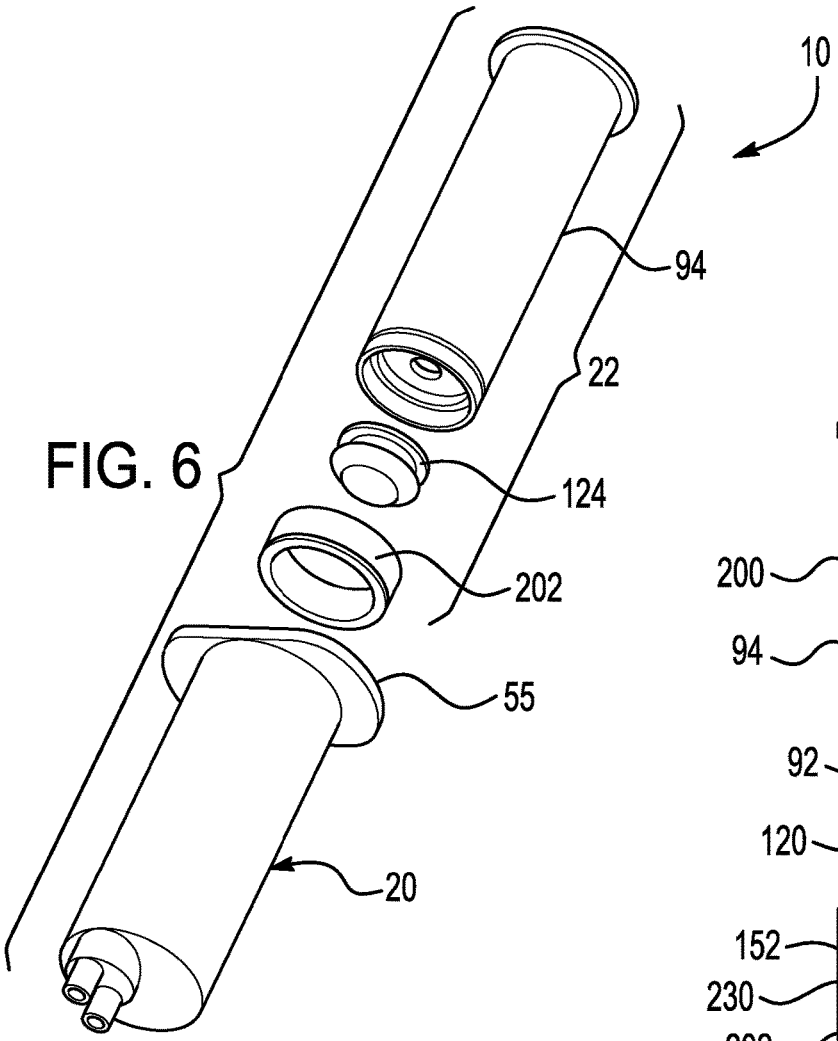
FIG. 6 is an exploded schematic of the housing and plunger of FIG. 4.
Figure 17:
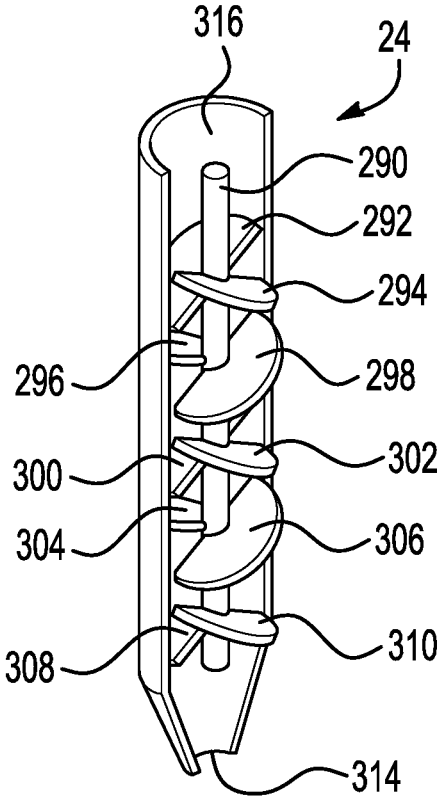
FIG. 17 is a cut-a-way view of a portion of a static mixer assembly utilized in the dispenser assembly of FIG. 1.

Referring to FIGS. 2 and 17, a static mixer assembly 24 is provided to mix the first and second chemical compounds 26, 28 that are being dispensed from the first and second outlet members 56, 58 of the housing 20. The static mixer assembly 24 is fluidly coupled to the first and second outlet members 56, 58 of the housing 22 and receives the first and second chemical compounds 26, 28 therein. It is noted that the static mixer assembly is an optional component of the dispenser assembly 10. The static mixer assembly 24 includes a blade assembly 280 and a nozzle member 282. In an exemplary embodiment, the static mixer assembly 24 is press-fit around the coupling portion 67 of bottom housing wall 54 to couple the static mixer assembly 24 to the housing 20. In an alternative embodiment, the static mixer assembly 24 may be coupled to the housing 20 utilizing threads on both the nozzle member 282 and the coupling portion 67 of bottom housing wall 54, or utilizing a bayonet connection on the nozzle member 282 and the coupling portion 67 of bottom housing wall 54.

The blade assembly 280 includes a central shaft 290 and blades 292, 294, 296, 298, 300, 302, 304, 306, 308, 310 which are coupled to the central shaft 290. In an exemplary embodiment, the central shaft 290 and the blades 292-310 are constructed of plastic.

The nozzle member 282 is provided to hold the blade assembly 280 therein. The nozzle member 282 is tubular-shaped and includes an inlet 312 and an outlet 314. In an exemplary embodiment, the nozzle member 282 is constructed of plastic. Further, an end of the central shaft 290 (shown in FIG. 3) may be disposed in an aperture 69 (shown in FIG. 3) that is defined by the coupling portion 67 of bottom housing wall 54—when the static mixer assembly 24 is press-fit around the coupling portion 67 of bottom housing wall 54.

During operation, the static mixer assembly 24 receives the first and second chemical compounds 26, 28 from the first and second outlet members 56, 58, respectively, which then flow through an interior region 316 (shown in FIG. 17) of the nozzle member 282. The blades 292-310 mix the first and second chemical compounds 26, 28 together to obtain a mixed compound which is then dispensed from the interior region 316 through the outlet 314 of the nozzle member 282.

Figure 20:
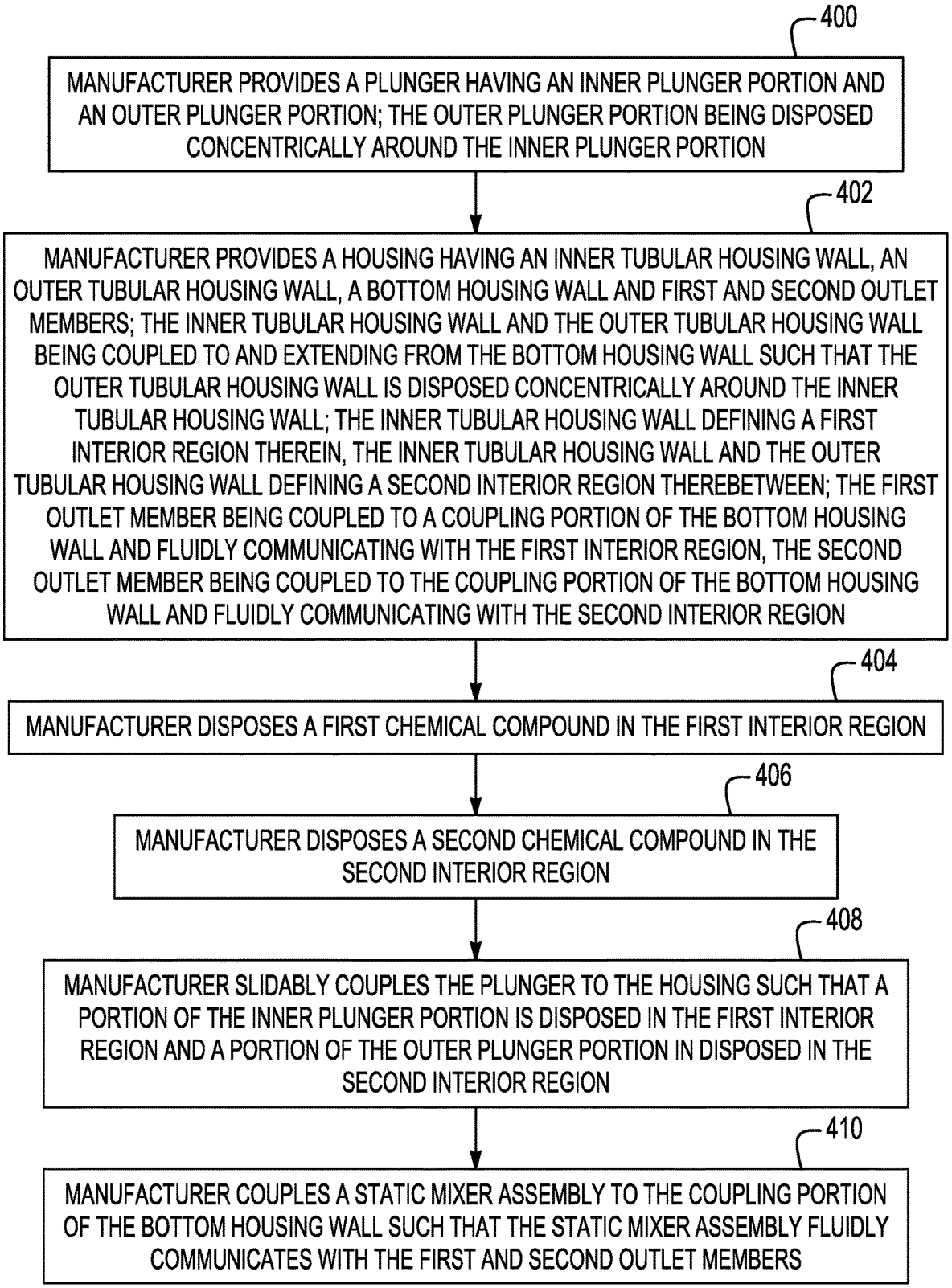
FIG. 20 is a flowchart of a method for manufacturing the dispenser assembly of FIG. 1 in accordance with another exemplary embodiment.

Referring to FIGS. 2, 7 and 20, a flowchart of a method for manufacturing the dispenser assembly 10 in accordance with an exemplary embodiment will be explained.

At step 400, a manufacturer provides a plunger 22 having an inner plunger portion 92 and an outer plunger portion 94. The outer plunger portion 94 is disposed concentrically around the inner plunger portion 92. After step 400, the method advances to step 402.

At step 402, the manufacturer provides a housing 20 having an inner tubular housing wall 50, an outer tubular housing wall 52, a bottom housing wall 54, and first and second outlet members 56, 58. The inner tubular housing wall 50 and the outer tubular housing wall 52 are coupled to and extend from the bottom housing wall 54 such that the outer tubular housing wall 52 is disposed concentrically around the inner tubular housing wall 50. The inner tubular housing wall 50 defines a first interior region 60 therein. The inner tubular housing wall 50 and the outer tubular housing wall 52 defines a second interior region 62 therebetween. The first outlet member 56 is coupled to a coupling portion 67 of the bottom housing wall 54 and fluidly communicates with the first interior region 60. The second outlet member 58 is coupled to the coupling portion 67 of the bottom housing wall 54 and fluidly communicates with the second interior region 62. After step 402, the method advances to step 404.

At step 404, the manufacturer disposes a first chemical compound 26 in the first interior region 60. After step 404, the method advances to step 406.

At step 406, the manufacturer disposes a second chemical compound 28 in the second interior region 62. After step 406, the method advances to step 408.

At step 408, the manufacturer slidably couples the plunger 22 to the housing 20 such that a portion of the inner plunger portion 92 is disposed in the first interior region 60 and a portion of the outer plunger portion 94 is disposed in the second interior region 62.

At step 410, the manufacturer couples a static mixer assembly 24 to a coupling portion 67 of the bottom housing wall 54 such that the static mixer assembly 24 fluidly communicates with the first and second outlet members 56, 58.

The dispenser assembly 10 provides a substantial advantage over other assemblies and methods. In particular, the dispenser assembly 10 provides an advantage of dispensing a consistent mix ratio of the first and second chemical compounds 26, 28 even if a longitudinal axis 96 of the plunger 22 is tilted/offset from a longitudinal axis 64 of the housing 20 during use thereof. In particular, the dispenser assembly 10 utilizes the plunger 22 with an inner plunger portion 92 and an outer plunger portion 94 concentrically disposed around the inner plunger portion 92 to urge the first and second chemical compounds 26, 28, respectively, in first and second interior regions 60, 62, respectively, to be dispensed at a desired mix ratio (e.g., desired amount of both the first and second chemical compounds 26, 28).

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A dispenser assembly for dispensing first and second chemical compounds, comprising:

a plunger having an inner plunger portion and an outer plunger portion; the outer plunger portion being disposed concentrically around the inner plunger portion; and a housing having an inner tubular housing wall, an outer tubular housing wall, a bottom housing wall, and first and second outlet members; the inner tubular housing wall and the outer tubular housing wall being coupled to and extending from the bottom housing wall such that the outer tubular housing wall is disposed concentrically around the inner tubular housing wall; the inner tubular housing wall defining a first interior region therein, the inner tubular housing wall and the outer tubular housing wall defining a second interior region therebetween; the first outlet member being coupled to the bottom housing wall and fluidly communicating with the first interior region, the second outlet member being coupled to the bottom housing wall and fluidly communicating with the second interior region;

the inner plunger portion being slidably received in the first interior region; the inner plunger portion having an inner tubular plunger wall, a bottom plunger wall, and a tip member, and the outer plunger portion being slidably received in the second interior region; the outer plunger portion having an outer tubular plunger wall and an annular seal, the annular seal being coupled to an end portion of the outer tubular plunger wall.

2. The dispenser assembly of claim 1, wherein:

the plunger further having a top plunger wall;

the inner tubular plunger wall and the outer tubular plunger wall being coupled to and extending from the top plunger wall such that the outer tubular plunger wall is disposed concentrically around the inner tubular plunger wall, the bottom plunger wall being coupled to an end of the inner tubular plunger wall; and the tip member being coupled to the bottom plunger wall and communicating with the first interior region.

3. The dispenser assembly of claim 2, wherein:

the bottom plunger wall having an aperture extending therethrough; and the tip member having a coupling tab that extends through the aperture in the bottom plunger wall to couple the tip member to the bottom plunger wall.

4. The dispenser assembly of claim 2, wherein:

the annular seal having a groove extending from a top surface thereof into the annular seal; and the end portion of the outer tubular plunger wall extending into the groove to couple the outer tubular plunger wall to the annular seal.

5. The dispenser assembly of claim 2, wherein:

the top plunger wall having an outer circumference than is larger than an outer circumference of the outer tubular plunger wall.

6. The dispenser assembly of claim 2, wherein:

the annular seal being an elastomeric annular seal; and the tip member being an elastomeric tip member.

7. The dispenser assembly of claim 1, wherein:

the first chemical compound being disposed in the first interior region; and the second chemical compound being disposed in the second interior region.

8. The dispenser assembly of claim 7, wherein:

the plunger having a first operational position in which the first and second chemical compounds are maintained in the first and second interior regions, respectively, of the housing; and the plunger having a second operational position in which the first and second chemical compounds are dispensed from the first and second interior regions, respectively, and through the first and second outlet members, respectively.

9. The dispenser assembly of claim 7, wherein:

the plunger pushing against the first and second chemical compounds to dispense a consistent ratio of the first and second chemical compounds through the first and second outlet members even when a force being applied to the plunger causes a longitudinal axis of the plunger to not be coincident to a longitudinal axis of the housing.

10. The dispenser assembly of claim 7, further comprising:

a static mixer assembly being coupled to a coupling portion of the bottom housing wall such that the static mixer assembly fluidly communicates with the first and second outlet members, the static mixer assembly mixing the first and second chemical compounds together as the first and second chemical compounds pass through an interior region of the static mixer assembly.

11. The dispenser assembly of claim 1, wherein:

a volume of the first interior region is equal to a volume of the second interior region.

12. The dispenser assembly of claim 1, wherein:

a static mixer assembly being coupled to a coupling portion of the bottom housing wall such that the static mixer assembly fluidly communicates with the first and second outlet members.

13. The dispenser assembly of claim 12, wherein:

the static mixer assembly including a blade assembly and a nozzle member, the blade assembly being disposed within the nozzle member, the blade assembly including a central shaft and a plurality of blades coupled to the central shaft.

14. A method for manufacturing a dispenser assembly, comprising:

providing a plunger having an inner plunger portion and an outer plunger portion; the outer plunger portion being disposed concentrically around the inner plunger portion; the inner plunger portion having an inner tubular plunger wall, a bottom plunger wall, and a tip member; the outer plunger portion having an outer tubular plunger wall and an annular seal, the annular seal being coupled to an end portion of the outer tubular plunger wall;

providing a housing having an inner tubular housing wall, an outer tubular housing wall, a bottom housing wall, and first and second outlet members; the inner tubular housing wall and the outer tubular housing wall being coupled to and extending from the bottom housing wall such that the outer tubular housing wall is disposed concentrically around the inner tubular housing wall; the inner tubular housing wall defining a rust interior region therein, the inner tubular housing wall and the outer tubular housing wall defining a second interior region therebetween; the first outlet member being coupled to the bottom housing wall and fluidly communicating with the rust interior region, the second outlet member being coupled to the bottom housing wall and fluidly communicating with the second interior region;

disposing a first chemical compound in the rut interior region;

disposing a second chemical compound in the second interior region; and slidably coupling the plunger to the housing such that a portion of the inner plunger portion is disposed in the first interior region, and a portion of the outer plunger portion is disposed in the second interior region.

15. The method of claim 14, further comprising:

coupling a static mixer assembly to a coupling portion of the bottom housing wall such that the static mixer assembly fluidly communicates with the first and second outlet members.

* * * * *